United States Patent [19]

Ziegler

[11] Patent Number: 4,487,611

[45] Date of Patent: Dec. 11, 1984

[54] GAS COOLER FOR A SYNTHETIC GAS

[75] Inventor: Georg Ziegler, Winterthur, Switzerland

[73] Assignee: Sulzer Brothers Limited, Winterthur, Switzerland

[21] Appl. No.: 421,304

[22] Filed: Sep. 22, 1982

[30] Foreign Application Priority Data

Oct. 23, 1981 [CH] Switzerland ..... 6785/81

[51] Int. Cl.[3] ..... C10J 3/84

[52] U.S. Cl. ..... 48/69; 48/67; 48/128; 48/DIG. 2; 55/222; 55/228; 110/171

[58] Field of Search ..... 110/171, 216; 122/7 R; 48/69, DIG. 2, 128, 67; 55/222, 228

[56] References Cited

U.S. PATENT DOCUMENTS

| | | | |
|---|---|---|---|
| 3,441,393 | 4/1969 | Finneran et al. | 48/214 R |
| 4,020,773 | 5/1977 | Blach | 110/165 R |
| 4,073,629 | 2/1978 | Funk | 48/77 |
| 4,213,402 | 7/1980 | Kochey | 110/171 |
| 4,295,866 | 10/1981 | Kearny | 55/228 |
| 4,329,929 | 5/1982 | Jessen | 110/171 |
| 4,395,268 | 7/1983 | Zabelka | 48/67 |

FOREIGN PATENT DOCUMENTS

| | | | |
|---|---|---|---|
| 2033563 | 9/1979 | United Kingdom | 48/DIG. 2 |

*Primary Examiner*—Jay H. Woo
*Assistant Examiner*—J. Lucinda Woodard
*Attorney, Agent, or Firm*—Kenyon & Kenyon

[57] ABSTRACT

The gas cooler has a downcomer bounded by radiant cooling walls and a waterbath at the end of the downcomer. The depth of the waterbath is several times its horizontal extent and the waterbath is flowed through downwardly by water. The bath is connected by way of a pump, heat exchanger and a feed line to a water circuit. Means are provided to control the water temperature at its entry into the waterbath so that the entry temperature is maintained at a value somewhere between the dew point of the synthesis gas and the evaporation point of water at the working pressure of the synthesis gas.

The result is substantial obviation of evaporation of water from the waterbath and the associated heat losses.

11 Claims, 3 Drawing Figures

GAS COOLER FOR A SYNTHETIC GAS

This invention relates to a gas cooler for a synthesis gas. More particularly, this invention relates to a gas cooler for a synthesis gas generator.

Heretofore, it has been known to connect a gas cooler to a synthesis gas producer in order to cool the synthesis gas while removing impurities from the gas. One known gas cooler, as described in U.S. Pat. No. 4,395,268, has a downcomer which is bounded by radiant cooling walls, a waterbath at the end of the downcomer, a number of exit orifices for the cooled synthesis gas which are disposed in the downcomer walls closely above the waterbath and a closeable waste removal aperture in the lowest part of the waterbath. However, this gas cooler has a disadvantage in that the water evaporates from the waterbath with a loss of relatively high-temperature heat. This event results in a reduction of the caloric value of the synthesis gas and is associated with thermo-dynamic losses.

It has also been known to provide a waterbath in steam generators having a liquid slag removal. However, the temperature of the bath is so low that very little vapor is evolved when the slag is quenched. Thus, the water temperature remains so low that it is not worthwhile to use the heat energy of the water. Further, condensation of the flue gases usually occurs.

Accordingly, it is an object of the invention to be able to cool a synthesis gas without reducing the caloric value of the gas.

It is another object of the invention to be able to cool a synthesis gas in an efficient thermo-dynamic manner.

It is another object of the invention to cool a synthesis gas while readily removing impurities therefrom.

Briefly, the invention provides a gas cooler for a synthesis gas which comprises a downcomer for receiving and cooling a downward flow of synthesis gas, which downcomer has outlets near a lower end for an outflow of the cooled synthesis gas. In addition, the cooler has first means for defining a waterbath below the downcomer having a depth several times a horizontal extent thereof, second means for circulating a flow of water through the first means in a downward direction and third means for controlling the temperature of the return flow of the water to the waterbath. This third means serves to maintain the temperature of the return flow at a value between the dew point of the synthesis gas and the evaporation point of the water at the working pressure of the synthesis gas.

The means for circulating the water includes a water removal means within the waterbath, a pump circulating the water and a heat exchanger for cooling the return flow of water.

The relationship between the dimensions of the waterbath, in co-operation with circulation of the water, has the result that the water temperature at the bath surface is substantially equal to the entry temperature of the water coming from the heat exchanger, and then rises to a maximum during the downward flow to the removal station. Consequently, not only is there a considerable reduction of evaporation but also the circulating water is heated to a relatively high temperature so that its heat content can be used in the heat exchanger, yet no condensation occurs on the gas cooler part in contact with synthesis gas.

The gas cooler can be constructed so that the means defining the waterbath includes a vessel for receiving the return flow of water, a narrowing at a lower end of the vessel, an insert which extends downwardly from the narrowing and a casing which is spaced about the insert to define an annular chamber therebetween. In addition, a slag breaker is disposed near the bottom end of the insert while a water removal station of the circulating means is disposed in the annular chamber between the insert and the casing. With this construction, the slag particles which are deposited out of the synthesis gas yield most of their heat energy in the waterbath and are then largely deposited. Hence, the water supplied for thermal use can be removed from the bath in a fairly clean state.

A separator may also be positioned between the waterbath and the pump for removing particles from the water of a different density and/or aggregate state from water. This serves to obviate the depositing of slag particles in the heat exchanger. Of note, any such deposition would increase the temperature difference on the heat exchanger surfaces and thus cause thermo-dynamic losses.

Where the downcomer is defined by radiant cooling walls, a very efficient use of the heat obtained from the waterbath can be effected by connecting a vapor generator to the cooling walls in order to deliver a working medium to the walls for cooling the walls. In addition, the vapor generator can be connected to the heat exchanger of the water circulating means on the secondary side in order to supply a working medium thereto.

In order to insure that the water level in the waterbath always remains at an optimum height, a water supply means is provided for feeding water to the water circulating means. In addition, a water level sensor is disposed in the waterbath for selectively activating the supply means in response to the level of water in the waterbath.

In order to insure that heavy particles of slag do not reach the slag breaker too fast and after merely surface quenching, at least one flap gate is provided in the waterbath above the slag breaker. Thus, the slag breaker cannot become soiled by sticky slag and, thus, rendered unservicable.

Further, in order to prevent formation of a layer of slag particles on the water surface which might buoy up heavy particles and prevent these particles from being immersed in the water, a water draw-off device is provided near an upper end of the waterbath for drawing off a surface water layer having floating particles therein. In addition, a valve is connected to the draw-off device for selectively activating the draw-off device, for example periodically or continuously, as required.

These and other devices and advantages of the invention will become more apparent from the following detailed description taken in conjunction with the accompanying drawings wherein.

Figures 1, 2, 3:
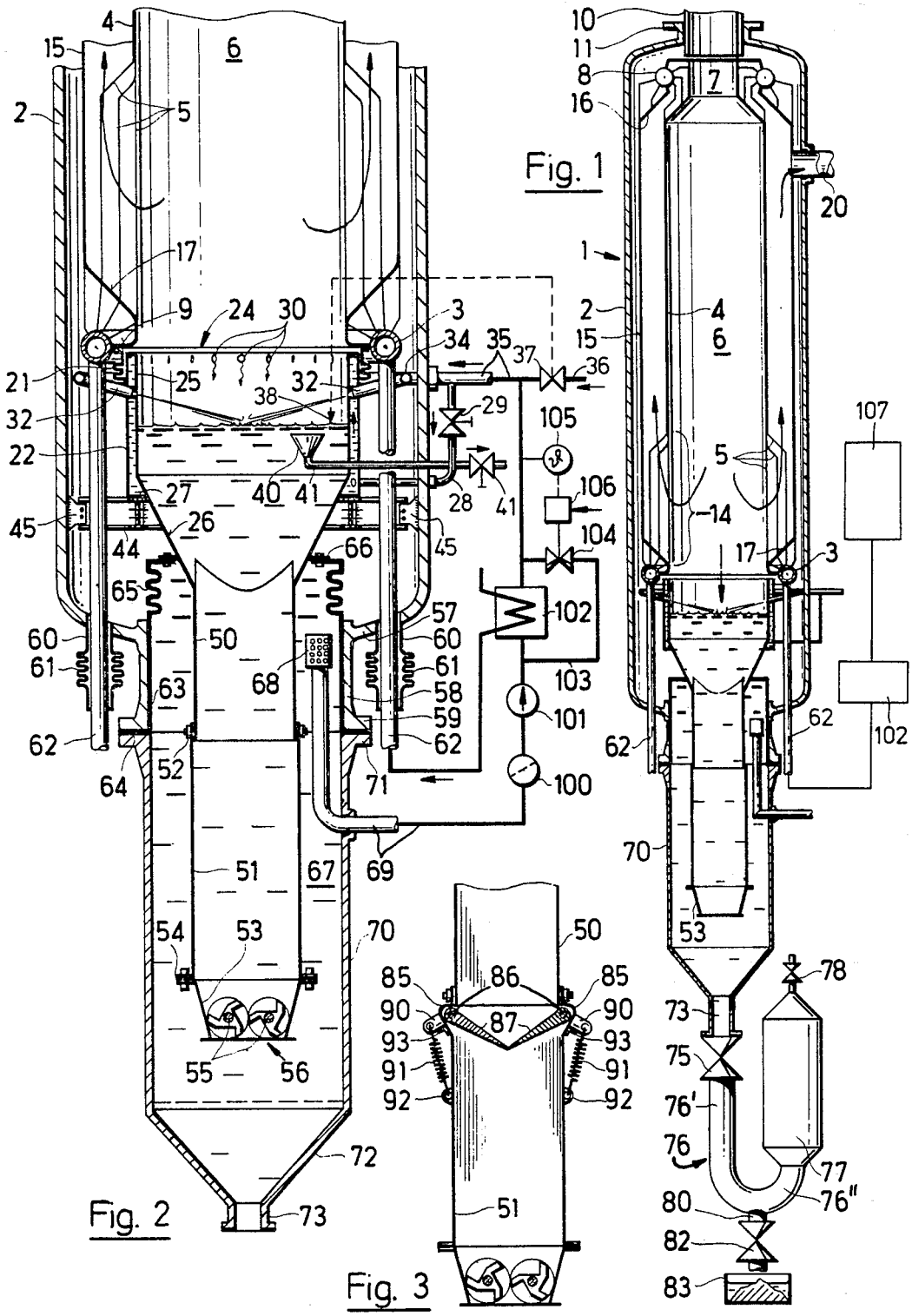
FIG. 1 illustrates a diagrammatic vertical sectional view through a gas cooler constructed in accordance with the invention.
FIG. 2 illustrates a partial view to a larger scale of a bottom part of the gas cooler of FIG. 1.
FIG. 3 illustrates a vertical section through a modified portion of a gas cooler in accordance with the invention.

Referring to FIG. 1, the gas cooler 1 is provided for cooling a synthesis gas. As illustrated, the gas cooler 1 is embodied by a pressure vessel or tank 2 within which a coaxial downcomer 6 is vertically disposed. As indicated, the downcomer 6 is formed by a plurality of tubes 5 which start from a ring main 3 and which are interconnected in gas-tight manner to form a cylindrical tube bank 4 i.e., a plurality of radiant cooling walls. The tubes 5 are also drawn in at the top ends to form a throat 7 and terminate in a ring collector 8.

The end face of the throat 7 merges in sealed relation into a thermally insulated spigot 10 which extends through a top flange 11 of the pressure vessel 2. This spigot 10 may be the component of a coal gasification reactor (not shown).

Referring to FIGS. 1 and 2, some of the tubes 5 are bent out in a bottom zone 14 in order to define a plurality of outlets near a lower end of the downcomer 6 for an outflow of cooled synthesis gas.

The pressure vessel 2 also houses a tube bank 15 which is formed by a plurality of vertical tubes which are welded together in seal-tight manner via connnecting webs. The tube bank 15 forms an annular chamber with the tube bank 4 and includes an upper conical sealing surface 16 and a bottom conical sealing surface 17. Like the tubes 5, the tubes of the bank 15 are connected to the ring main 3 and ring collector 8. Further, the tube bank 15 has a radial gas exit spigot 20 near the top which extends through the wall of the pressure vessel 2.

Referring to FIG. 2, the connecting webs of those tubes of the bank 15 which start from the conical sealing surface 17 form a flange 9 in the center plane of the ring main 3. In addition, a horizontal flange of a ring bellows 21 is sealingly secured to the flange 9 via the interposition of a sealing means (not shown).

The gas cooler also has a means for defining a waterbath below the lower end of the downcomer 6 which has a depth several times a horizontal extent thereof. As shown, this means includes a cylindrical double-wall vessel 24 which has an outside wall 22 welded to a bottom end of the bellows 21. The inner wall 25 of the vessel 24 merges at the bottom end into a narrowing or cone 26 which is sealingly welded to the outside of the bottom end of the outside wall 22 via a metal ring 27. The wall cavity of the vessel 22 is supplied near a bottom end with water via a line 28 which is provided with a shut-off member 29. The inner wall 25 is also provided with a plurality of water exit orifices 30 near the top edge. Thus, water which rises through the cavity enters the central chamber of the vessel 24 via these orifices 30. In addition, a plurality of injection lances 32 extend through both walls 22, 25 of the vessel 24 approximately in the top third thereof. These lances 32 narrow in nozzle-fashion at the front ends and are connected at the rear to a ring main 34 which is supplied with heated water through a supply line 35. As indicated, the line 28 is also connected to the supply line 35 outside the pressure vessel 2.

The double wall vessel 24 rests via the metal ring 27 on a framework 44 consisting of double channel section beams which are secured to the pressure vessel wall via connecting plates or the like 45.

The means for defining the waterbath also includes an insert which extends downwardly from the narrowing 26. As shown in FIG. 2, this insert is composed of a vertical rectangular duct 50 which extends from the narrowing 26, a duct 51 of similar cross section which is secured below and to the duct 50 via screws 52 and a terminal member 53 which is connected to the bottom end of the duct 51 via a flange connection 54. The terminal member 53 has four walls with two opposite walls inclined towards one another. In addition, a slag breaker 56 formed of two breaker rolls 55, is disposed in the narrowest region at the bottom end of the terminal member 53.

As indicated, the pressure vessel 2 includes a base 57 at a lower end having a central spigot 58 which terminates in a flange 59. In addition, the base 57 has two spigots 60 to each of which a bellows 61 is connected while a water supply tube 62 is sealingly welded to the bottom end of each bellows 61 and extends through a spigot 60 to the ring main 3. In addition, a sleeve 63 engages in the spigot 58 and has a flange 64 which abuts the flange 59. The top end of the sleeve 63 is releaseably secured via a bellows 65 to a flange 66 secured to the narrowing 26.

The means for defining the waterbath also includes a cylindrical casing 70 which is spaced about the duct 51 and terminal member 53 of the insert in order to define an annular chamber 67 therebetween. As indicated, the casing 70 which is in the form of a cylindrical wall is secured via an upper flange 71 to the flange 59 of the pressure vessel 2 and the flange 64. The lower end of the casing 70 is provided with a conical base 72 from which a central exit spigot 73 extends.

Referring to FIG. 2, each of the breaker rolls 55 is driven by a motor (not shown) by way of a shaft which has universal joints (not shown) and which extends through the casing 70.

As shown in FIG. 2, a water draw-off device 40 is disposed near an upper end of a waterbath for drawing off a surface water layer having floating particles therein. This device 40 is in the form of a funnel which connects to a line 41 which extends through the walls 25, 22 of the vessel 24 and through the pressure vessel 2. In addition, the line 41 is provided with a valve 41' which is able to selectively activate the draw-off device.

The gas cooler also has a means for circulating a flow of water through the waterbath. This means includes a water removal means in a form of a suction rose 68 in the annular chamber 67 between the top duct 50 and the sleeve 63. A water line 69 extends from the rose 68 through the casing 70 and passes by way of a separator 100 and a circulating pump 101 to a heat exchanger 102 which has an output connected to the water feed line 35.

The separator 100 is located between the waterbath and the pump for removing particles from the water of a different density and/or aggregate state from water. To this end, the separator 100 may be in the form of a filter or isolator or the like.

The heat exchanger 102 serves to cool a return flow of water to the feed line 35 and, hence, to the waterbath. The secondary side of the heat exchanger 102 may be connected as a feed water preheater of a steam generator. For example, as shown in FIG. 1, a steam or vapor generator 107 can be connected to supply a working medium to the heat exchanger 102 for cooling the return flow of water and to the supply tube 62 to supply the working medium to the cooling walls 4.

The gas cooler also has a means for controlling the temperature of the return flow of water to the waterbath so that the temperature is maintained at a value between the dew point of the synthesis gas and the evaporation point of the water at the working pressure of the synthesis gas. This means includes a bypass line 103 which is in parallel with the heat exchanger 102, a control valve 104 in the bypass line 103 and a controller 106 for opening and closing the valve 104 in order to vary the flow through the bypass line 103. As indicated, the bypass line 103 connects to the feed line 35. A temperature-measuring element 105 is connected to the feed line 35 downstream of the junction with the bypass line 103 in order to transmit signals to the controller 106 which correspond to the water temperature in the feed line 35. The controller 106 compares the received temperature signal with a set value signal and generates a difference signal in response. The controller 106 is operatively connected to the valve 104 so as to open or close the valve 104 to adjust the quantity of water to be bypassed the heat exchanger 102 through the bypass line 103 in dependence upon the difference detected by the controller 106 between the measured temperature and the set-valve temperature.

As shown in FIG. 1, the spigot 73 at the lower end of the casing 70 is associated with a shut-off element 75 to act as a caloric waste removal aperture. As indicated, the shut-off element 75 is disposed on the upper end of one arm 76' of a Y-shaped junction element 76. The other arm 76'' carries a lock chamber 77 having an air vent valve 78 while the stem 80 has a shut-off element 82 which terminates above a slag collection trough 83.

As can be gathered from FIG. 2, the depth of the waterbath is from the water level in vessel 24 as far as the entry of the water into the slag breaker 56. This depth is several times the horizontal extent of the waterbath, such extent corresponding to the internal diameter of the inner wall 25 of vessel 24.

The gas cooler 1 described operates as follows:

Reaction products (synthesis gas with liquid slag particles) at a temperature of more than 900° C. flow from a coal gasification reactor (not shown) through the spigot 10 into the downcomer 6 which can be, for instance, 30 meters long. The reaction products yield heat in the downcomer 6 to the tube bank 4, preferably by radiation with most of the slag particles solidifying at least on the surface. When the gas is deflected in the bottom zone 14 of downcomer 6, the slag particles are substantially deflected from their line of fall by the gas forces and are hurled into the waterbath or on to the conical surface 17. The conical surface 17 is so steep that the slag particles dropping thereon slide or roll into the waterbath. The thus pre-cleaned synthesis gas rises through the annular chamber between the tube banks 4 and 15 and, either directly by way of the spigot 20 or by way of a separator, enters a convection cooler in which heat is also removed from the synthesis gas.

The centrifuged slag particles drop in the waterbath, solidifying throughout as they do so. Relatively large particles of slag are crushed in the slag breaker 56 before being deposited on the conical base 72 and settling thereon. Sediments are removed periodically from the base 72 by opening of the shut-off element 75 so that—with the shut-off element 82 closed—water and sediments are forced at high pressure into the lock chamber 77, in which air at atmospheric pressure was present initially. The air in the chamber 77 is compressed temporarily in the top part of the chamber 77. After pressure equilization the element 75 is closed and the air vent valve 78 opens so that the air escapes and the pressure in the chamber 77 decreases. The shut-off element 82 then opens so that water and sediments discharge from the chamber 77 into the trough 83. If necessary, the chamber 77 is scavenged, for instance, with water. The shut-off element 82 and valve 78 close, so that the discharge facility is ready for the next discharge operation.

To prevent air from rising into the waterbath during discharge, the element 76 can be filled with water, to which end, the arm 76' extending to the element 75 can be adapted to be air-vented.

During operation of the gas cooler, the pump 101 continuously circulates water through the waterbath. Such water is introduced thereinto, by way of line 35 and under the control of the bypass line 103 and controller 106 at a temperature whose bottom limit is the dew point of the synthesis gas and whose top limit is the boiling point of water at the pressure of the synthesis gas, preferably in the bottom third of this temperature range. The water to be introduced into the waterbath has one entry by way of the line 28 into the wall cavity of the vessel 24. This water rises in the wall cavity and discharges through the orifices 30 and along inner wall 25 to the waterbath surface. Another water entry is from the feed line 35 by way of the ring main 34 and lances 32 to the waterbath surface. The water entering via the lances 32 agitates the waterbath and provides cooling on all sides of the still incompletely solidified particles which are in movement on the bath surface because of the Leidenfrost phenomenon. The bathwater then circulates downwardly, being further heated by the entrained particles. The result of the pressure drop produced by the pump 101 and of the drag of the descending particles is that the water descends over the whole cross-section of the ducts 50, 51 although being warmer in the bottom of the bath than at the top, without inversion flows occuring.

Relatively large slag particles and pieces of slag dropping in the form of a stud or pin or the like are reduced in the breaker 56. The depth of the waterbath is such that even relatively substantial slag particle structures solidify throughout before entering the breaker 56. There is therefore no risk of the breaker 56 being soiled by sticky slag and thus becoming unserviceable. After the exit from breaker 56, the water in the annular chamber 67 rises while a substantial fraction of the slag particles settles on the conical base 72. Water is then returned to the feed line 35 by way of pump 101, rose 68, line 69, element 100 and heat exchanger 102.

Porous slag particles lighter than water may collect on the bath surface or float thereon because of appropriate surface tensions. Particles of this nature can be removed by way of the funnel 40.

Fresh water is added to make up for bath water losses due to removal of particles floating on the surface of the water, the removal of sediments together with water and unavoidable evaporation near the water surface. Water supply means are accordingly provided for injecting fresh water into the feed line 35 in response to the bath water level falling short of a predetermined set value. Conveniently, such supply means includes a line 36 to the feed line 35 and a valve 37 which is controlled by a water-level sensor pickoff 38 which can be a pressure difference measuring facility connected below and above the water surface for selectively actuating the supply means in response to the level of water in the water bath.

In operation, water is injected by way of the water supply tubes 62 and ring main 3 into the tubes of the tube banks 4, 15. The water is evaporated to some extent in the banks 4, 15. The water vapor mixture is removed by way of the ring collector 8 and tubes (not shown), for instance to a steam drum of a steam generator. The tubes of the two banks 4, 15 can be arranged, in a manner known from the steam generator art, either for natural circulation or for forced circulation or for forced-flow once-through conditions. Also, the different connections just mentioned can be changed over or superimposed upon one another to suit requirements.

The effect of limiting the temperature of the water supplied to the waterbath in the manner described is that no surface part in the gas cooler is at a lower temperature than the synthesis gas dew point. Consequently, dew from the synthesis gas is not deposited on such surfaces nor do gas fractions condense thereon. This is a very important consideration when the chamber or space between tube bank 15 and the wall of pressure tank 2 is full of stagnant synthesis gas for pressure equilization purposes.

The temperature of the water supplied to the gas cooler through the feed lines 35 is very close to the dew point temperature but sufficiently thereabove to ensure very little evaporation of water near the waterbath surface.

To prevent large incompletely solidified pieces of slag from reaching the breaker 56, means can be provided to inhibit the sinking of such pieces. Means of this kind are shown in FIG. 3 in the form of flap gates 87.

As indicated, an outwardly curved groove 85 is provided in each of the two long rectangular sides of the duct 51 and a shaft 86 is disposed in each groove 85 parallel to the adjacent wall to mount a respective flap gate 87 thereon in non-rotatable manner. The two shafts 86 extend through the short sides of the duct 51 and are secured in fixed fashion to levers 90 which have free ends acted on by spring 91 secured to the duct wall via a member 92. Abutments 93 are secured to the outside of the duct 51 to determine the closed position of the flap gates 87. When a piece of slag drops onto a flap gate 87, the force of the springs 91 and the inertia of the flap gates 87 must be overcome before the flap gates 87 open and allow the pieces to drop further. The fall or drop energy of the piece of slag is thus substantially absorbed by the flap gates 87. Since the flap gates 87 have to displace a considerable amount of water when opening, the gates 87 can open only relatively slowly.

Additional dampers to limit the speed of the flap gate 87 may also be provided.

The gas cooler has the advantage that, when out of operation and empty, it is relatively simple to inspect, clean and repair. Accordingly, after removal of the water, the casing 70 is dismantled, the line 69 and rose 68 also being removed. Access can then be obtained to the annular chamber 67 to release the connection by way of the flange 66, whereafter the member 63 can be dismantled downwards.

Access to the interior of the vessel 24 is by way of the top duct 50. The annular chamber between the outer wall 22 of the vessel 24 and the wall of vessel 2 is also readily accessible once the member 63 has been removed.

The ring main 3 is readily accessible once the connection between the bellows 31 and flange 9 has been released from the last-mentioned annular chamber and the connections of the tube 28 and lances 32 are separated. Thus, after the double-channel-section beams of the framework 44 have been shifted, the complete vessel 24 can be lowered.

The invention is by no means limited to the embodiment described. For instance, the sleeve 63 can be extended in cylindrical shape as far as the cone 26 and welded sealingly thereto in a ring seam. Conveniently, in this case, the narrowing 26 is divided close below the ring seam and the two parts are interconnected by a releasable threaded connection. The advantage of such a construction is that once the casing 70 and bottom duct 51 have been removed, removal of the bottom part of the narrowing 26 leads to a bigger access opening being available to the downcomer 6. The framework 44 could be abandoned and the pressure vessel 2 foreshortened at the bottom. Conveniently, in this case, the annular chamber between the vessel 24 and the vessel 2 could be made accessible by at least one manhole connection in the wall of the pressure vessel 2.

It may be desirable to devise the slag breaker 56, which is subject to wear, to be adapted for removal laterally. To this end, the duct end member 53 can be rigidly connected to the casing 70 by way of two parallel tubular members which extend coaxially of the breaker rolls 55. In this event, the rolls 55 are rigidly connected to the driving motor shafts, each such motor being sealingly connected by way of a flange to the outside of the wall of the casing 70. If it is required to avoid the use of two separate motors, the two rolls 55 can be driven by way of a gearing by a single motor.

What is claimed is:

1. A gas cooler for a synthesis gas, said cooler comprising radiant cooling walls defining a downcomer for receiving and cooling a downward flow of synthesis gas, said walls having a plurality of outlets near a lower end for an outflow of cooled synthesis gas from said downcomer;

first means for defining a waterbath below said lower end of said downcomer having a depth several times a horizontal extent thereof, said first means including a vessel having a funnel-like narrowing at a lower end, a downwardly extending insert extending from said narrowing to receive water therefrom, and a cylindrical wall spaced about said insert to define an annular chamber therebetween to receive a flow of water;

second means for circulating a flow of water through the waterbath in a downward direction, said second means including a water removal means in said annular chamber, a pump connected to said water removal means for circulating the flow of water and a heat exchanger for cooling a return flow of the water to the waterbath;

third means for controlling the temperature of the return flow of the water to the waterbath whereby the temperature is maintained at a value between the dew point of the synthesis gas and the evaporation point of the water at the working pressure of the synthesis gas; and a closeable waste removal aperture in the lowest part of the waterbath.

2. A gas cooler as set forth in claim 1 which further comprises a slag breaker near a bottom of said insert.

3. A gas cooler as set forth in claim 1 wherein said second means includes a separator between the waterbath and said pump for removing particles from the water of a different density and/or aggregate state from water.

4. A gas cooler as set forth in claim 1 comprising a vapor generator connected to said cooling walls to supply a working medium thereto for cooling said walls and to said heat exchanger for cooling the return flow of water.

5. A gas cooler as set forth in claim 1 which further comprises a water supply means for feeding water to said second means and a water level sensor in the waterbath for selectively activating said supply means in response to the level of water in the waterbath.

6. A gas cooler as set forth in claim 2 which further comprises at least one flap gate in the waterbath above said slag breaker.

7. A gas cooler as set forth in claim 1 which further comprises a water draw-off device near an upper end of the waterbath for drawing off a surface water layer having floating particles therein and a valve connected to said draw-off device for selectively activating said draw-off device.

8. A gas cooler for a synthesis gas, said cooler comprising a downcomer for receiving and cooling a downward flow of synthesis gas, said downcomer having outlets near a lower end for an outflow of the cooled synthesis gas;

first means for defining a waterbath below said downcomer having a depth several times a horizontal extent thereof, said first means including a vessel below said downcomer for receiving a flow of water, a narrowing at a lower end of said vessel, an insert extending downwardly from said narrowing and a casing spaced about said insert to define an annular chamber therebetween to receive a flow of water;

second means for circulating a flow of water through said first means in a downward direction, said second means including at least one outlet for introducing a return flow of the water into an upper end of the waterbath; and third means for controlling the temprature of the return flow of the water to the waterbath whereby the temperature is maintained at a value between the dew point of the synthesis gas and the evaporation point of the water at the working pressure of the synthesis gas.

9. A gas cooler as set forth in claim 8 wherein said second means includes a water removal means in said annular chamber, a pump for circulating the water and a heat exchanger for cooling the return flow of water.

10. A gas cooler as set forth in claim 9 wherein said third means includes a bypass line in parallel with said heat exchanger, a control valve in said bypass line, and a controller for opening and closing said valve to vary the flow through said bypass line.

11. A gas cooler as set forth in claim 8 wherein said second means includes a pump for circulating the water and a heat exchanger for cooling the return flow of water and said third means includes a bypass line in parallel with said heat exchanger, a control valve in said bypass line, and a controller for opening and closing said valve to vary the flow through said bypass line.

* * * * *